US009225098B2

(12) United States Patent
Shinmi

(10) Patent No.: US 9,225,098 B2
(45) Date of Patent: Dec. 29, 2015

(54) SPLICE BOX

(71) Applicant: YAZAKI CORPORATION, Minato-ku, Tokyo (JP)

(72) Inventor: Yoshifumi Shinmi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/451,484

(22) Filed: Aug. 5, 2014

(65) Prior Publication Data

US 2014/0342602 A1 Nov. 20, 2014

Related U.S. Application Data

(63) Continuation of application No. PCT/JP2013/000143, filed on Jan. 16, 2013.

(30) Foreign Application Priority Data

Feb. 8, 2012 (JP) ..... 2012-024881

(51) Int. Cl.
*H01R 13/514* (2006.01)
*H01R 13/46* (2006.01)
*H01R 13/422* (2006.01)
(Continued)

(52) U.S. Cl.
CPC ..... *H01R 13/46* (2013.01); *H01R 13/422* (2013.01); *H01R 31/08* (2013.01); *H01R 4/184* (2013.01); *H01R 2201/26* (2013.01)

(58) Field of Classification Search
CPC ... H01R 13/514; H01R 9/2408; H01R 13/506
See application file for complete search history.

(56) References Cited

U.S. PATENT DOCUMENTS 4,664,460 A 5/1987 Vandame
5,545,060 A * 8/1996 Gow ..... 439/717
(Continued)

FOREIGN PATENT DOCUMENTS

CN 1947311 A 4/2007
DE 8520470 U1 9/1985
(Continued)

OTHER PUBLICATIONS

The Japanese office action letter issued on Sep. 8, 2015 in the counterpart Japanese patent application.
(Continued)

*Primary Examiner* — Gary Paumen
(74) *Attorney, Agent, or Firm* — Marvin A. Motsenbocker; MOTS Law, PLLC

(57) ABSTRACT

A splice box includes: a housing including chambers each partitioned with each of partition walls, and slits each provided at each of the partition walls; and a splice terminals each including a terminal body portion inserted into and thereby received in each of the chambers, a pair of contact portions made to protrude from respective sides of the terminal body portion and arranged at the slits. A first contact portion and a second contact portion of each pair of adjacent splice terminals contact each other. Each of the chambers is provided with a pair of elastic portions so contacting side wall portions on respective sides of the terminal body portion as to have elastic deformation, and each of the elastic portions has a deformation portion formed by a part of the partition wall and a contact protrusion portion protruding from the deformation portion to the chamber side.

9 Claims, 7 Drawing Sheets

(51) Int. Cl.
*H01R 31/08* (2006.01)
*H01R 4/18* (2006.01)

(56) References Cited

U.S. PATENT DOCUMENTS

| | | | | |
|---|---|---|---|---|
| 6,332,811 | B1 * | 12/2001 | Sato | 439/701 |
| 6,354,887 | B2 * | 3/2002 | Maeda | 439/701 |
| 6,517,389 | B2 * | 2/2003 | Sato | 439/701 |
| 6,537,080 | B2 * | 3/2003 | Sato | 439/43 |
| 2002/0006752 | A1 | 1/2002 | Sato | |

FOREIGN PATENT DOCUMENTS

| | | | |
|---|---|---|---|
| JP | H02-110186 | | 9/1990 |
| JP | H06-036268 | U | 5/1994 |
| JP | H10-233254 | A | 9/1998 |
| JP | 2001-135401 | A | 5/2001 |
| JP | 2007-287611 | A | 11/2007 |
| JP | 2009211976 | A | 9/2009 |

OTHER PUBLICATIONS

Korean office action letter issued on Sep. 10, 2015 in the counterpart Korean patent application.

Chinese office action letter issued on Oct. 28, 2015 in the counterpart Chinese patent application.

Japanese office action letter issued on Nov. 17, 2015 in the counterpart Japanese patent application.

* cited by examiner

SPLICE BOX

CROSS REFERENCE TO RELATED APPLICATIONS

This application is a continuation of International Application No. PCT/JP2013/000143, filed Jan. 16, 2013, and based upon and claims the benefit of priority from Japanese Patent Application No. 2012-024881, filed Feb. 8, 2012, the entire contents of all of which are incorporated herein by reference.

TECHNICAL FIELD

The present invention relates to a splice box for establishing an electrical connection among a plurality of splice terminals inserted into a housing.

BACKGROUND ART

As a conventional splice box of this type, one disclosed in JP H06-036268 U is given. A conventional splice box 50 is, as illustrated in FIGS. 1 and 2, includes a housing 51 and a plurality of splice terminals 60 to be received in the housing 51. Not that, in FIG. 1, only one splice terminal 60 is illustrated, omitting other splice terminals 60.

The housing 51 includes a plurality of chambers 53 respectively partitioned by partition walls 52. Each of the partition walls 52 is provided with a slit 54.

Each of the splice terminals 60 includes a wire connecting portion 61 with which a wire W is connected, a terminal body portion 62 integrally provided integrated with the wire connecting portion 61, and a pair of contact portions 63 integrally provided with the terminal body portion 62. The terminal body portion 62 mainly includes a bottom wall portion 62*a* and a pair of left and right side wall portions 62*b*. The terminal body portion 62 is inserted into each of the chambers 53 and thereby received in each of the chambers 53. The pair of contact portions 63 are formed by being bent from upper ends of the pair of side wall portions 62*b*. The pair of contact portions 63 are arranged at the slits 54 positioned on left and right of the terminal body portion 62. The contact portions 63 of the splice terminal 60 received in the adjacent chambers 53 are overlapped with each other to be adhered to each other. The above structure electrically connects the adjacent splice terminals 60.

The conventional splice box 50, where the adjacent splice terminals 60 are electrically connected with each other directly, has such an advantage as that any intervening conductive member for connecting the splice terminals 60 with each other and any accessory of the intervening conductive member are not necessary.

SUMMARY OF INVENTION

According to the conventional splice box 50, the terminal body portion 62 of each of the splice terminals 60 is inserted into each of the chambers 53 and thereby received in each of the chambers 53. Thus, so as to enable the inserting of the splice terminal 60, dimensions are so set as to define a clearance between an outer face of each of the side wall portions 62*b* and an inner face of the partition wall 52.

However, with the clearance present between the side wall portion 62*b* and the partition wall 52, each of the splice terminals 60 vibrates in the receiving chamber 53 under a vibrational environment. There was such a problem as that, the vibration of each of the splice terminals 60 allows the contact point portions 63 of the adjacent splice terminals 60 to slide, thus increasing the contact point resistance. In the worst case, it is feared that a non-conduction is caused between the splice terminals 60.

Further, ordinarily, the housing 51 and the splice terminal 60 are made by materials which are different coefficients of the thermal expansion. Thus, the terminal body portion 62 of each the splice terminals 60 changes its position in each of the chambers 53 due to the temperature change. Then, there was such a problem as that the contact portion 63 of each of the splice terminals 60 changes its position, thus increasing the contact resistance.

For solving the above problems, the present invention has been made. It is an object of the present invention to provide a splice box capable of suppressing as much as possible the contact resistance increase caused by the vibration or the temperature change.

A splice box according to a first aspect of the present invention includes: a housing including chambers each partitioned with each of partition walls, and slits each provided at each of the partition walls; and splice terminals each including an wire connecting portion to be connected with a wire, a terminal body portion to be inserted into each of the chambers and thereby received in each of the chambers, a first contact portion protruding from a first side wall portion side of the terminal body portion and arranged at one of the slits adjacent to the first side wall portion, and a second contact portion protruding from a second side wall portion side of the terminal body portion and arranged at the other one of the slits adjacent to the second side wall portion. In each pair of adjacent splice terminals received in adjacent chambers, the first contact portion of one of the splice terminals has contact with the second contact portion of the other of the splice terminals to thereby electrically connecting the adjacent splice terminals. Each of the cambers is provided with a pair of elastic portions so contacting the first side wall portion and second side wall portion of each of the terminal body portions as to have an elastic deformation. Each of the elastic portions includes a deformation portion formed by a part of each of the partition walls and a contact protrusion portion protruding from the deformation portion to the chamber side.

It is preferable that the deformation portion is formed to be elastically deformable by providing a gap in a part of each of the partition walls, and that the contact protrusion portion has a contact face to have a contact with the side wall portions and formed into an arc face.

With the splice box according to the first aspect of the present invention, under a vibrational environment, even when the vibration is transmitted to each of the splice terminals so as to vibrate each of the splice terminals, since the pair of elastic portions are intervened between the pair of side wall portions of the terminal body portion and the partition walls on both sides, the pair of elastic portions causing the deformation suppress the vibration of the splice terminal. Further, even when the clearance between the side wall portions of the terminal body portion and the partition walls changes due to the temperature change, the pair of elastic portions vary the deformation amount to thereby absorb the clearance change. The absorbing of the clearance change keeps the splice terminal's position in the chamber unchanged, thus suppressing the fluctuation of the contact position between the contact portions of the adjacent splice terminals. To summarize the above, the contact resistance increase caused by the vibration or temperature change can be suppressed as much as possible.

DESCRIPTION OF EMBODIMENTS

Figure 1:
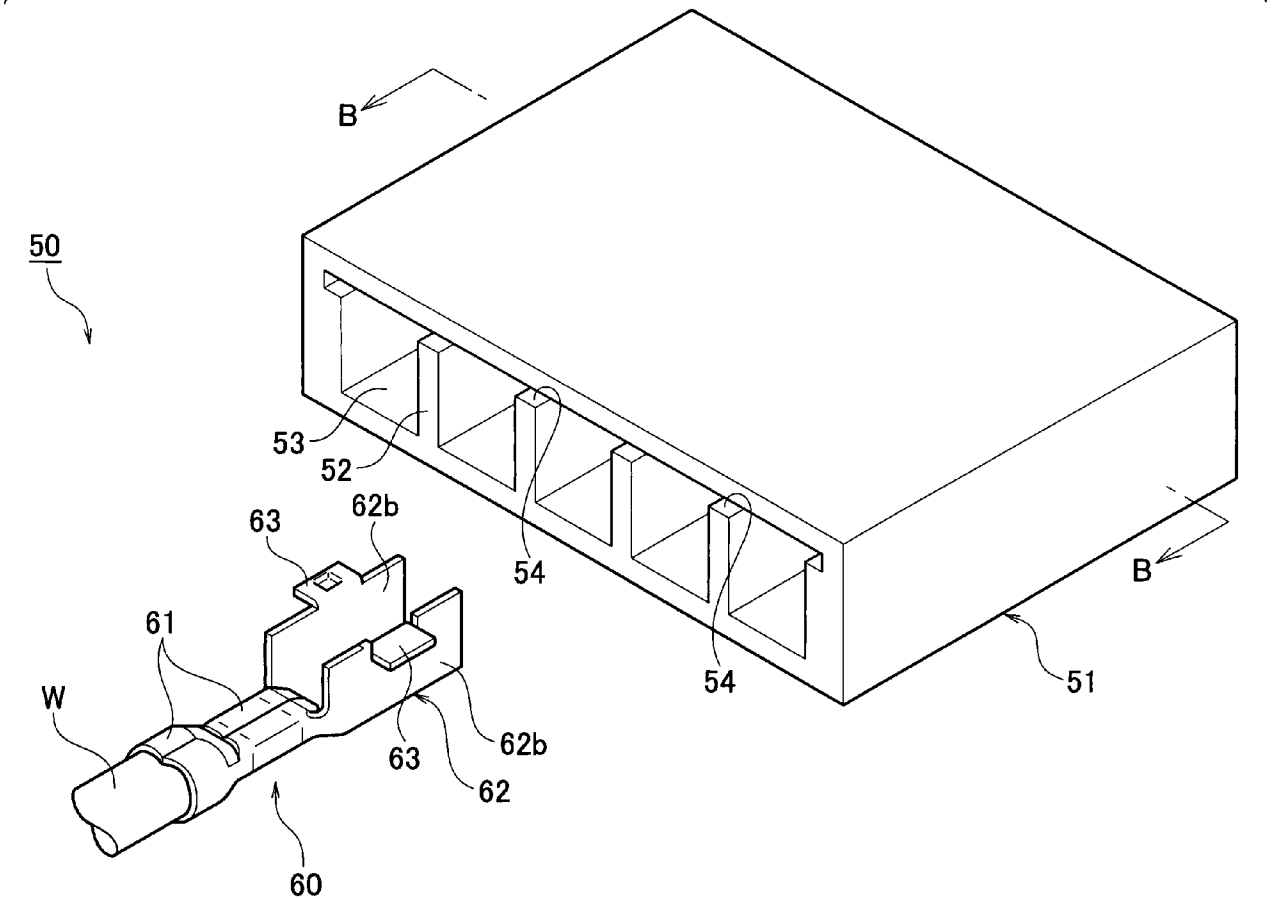
FIG. 1 is an exploded perspective view of a splice box according to a conventional example.
Figure 2:
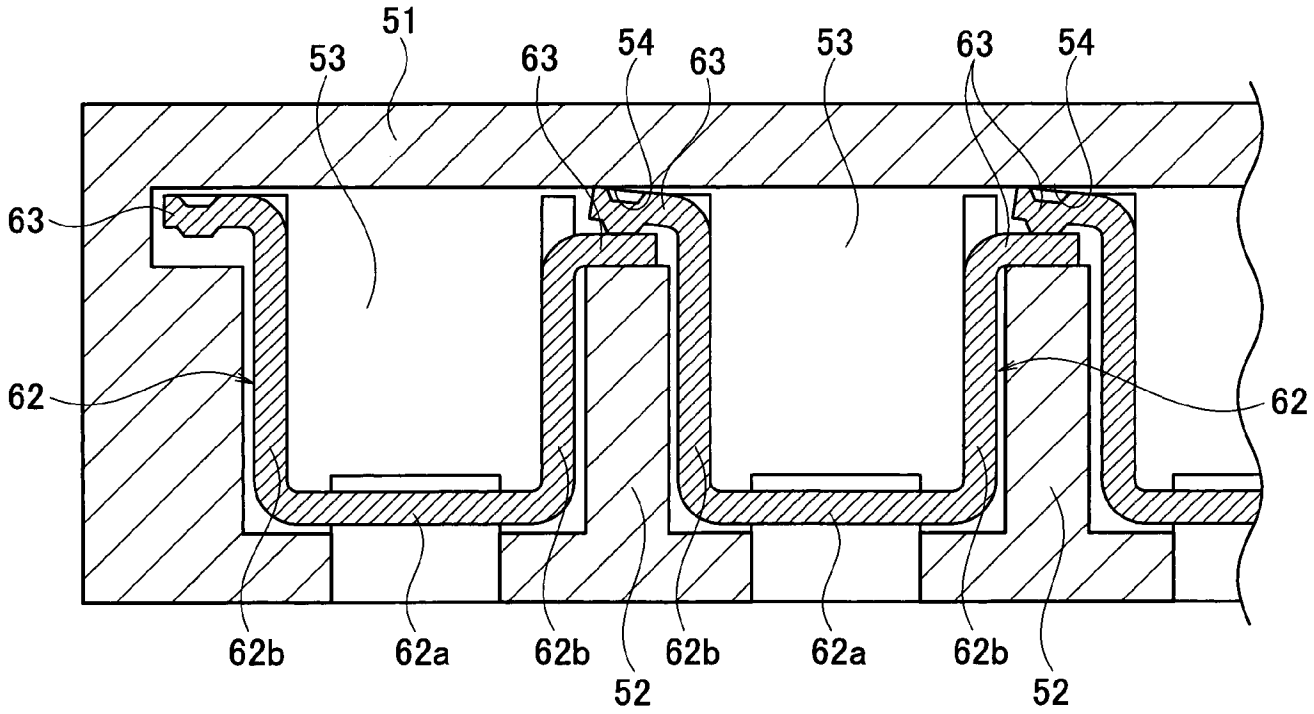
FIG. 2 is a partially enlarged cross sectional view taken along the line B-B in FIG. 1.
Figure 3:
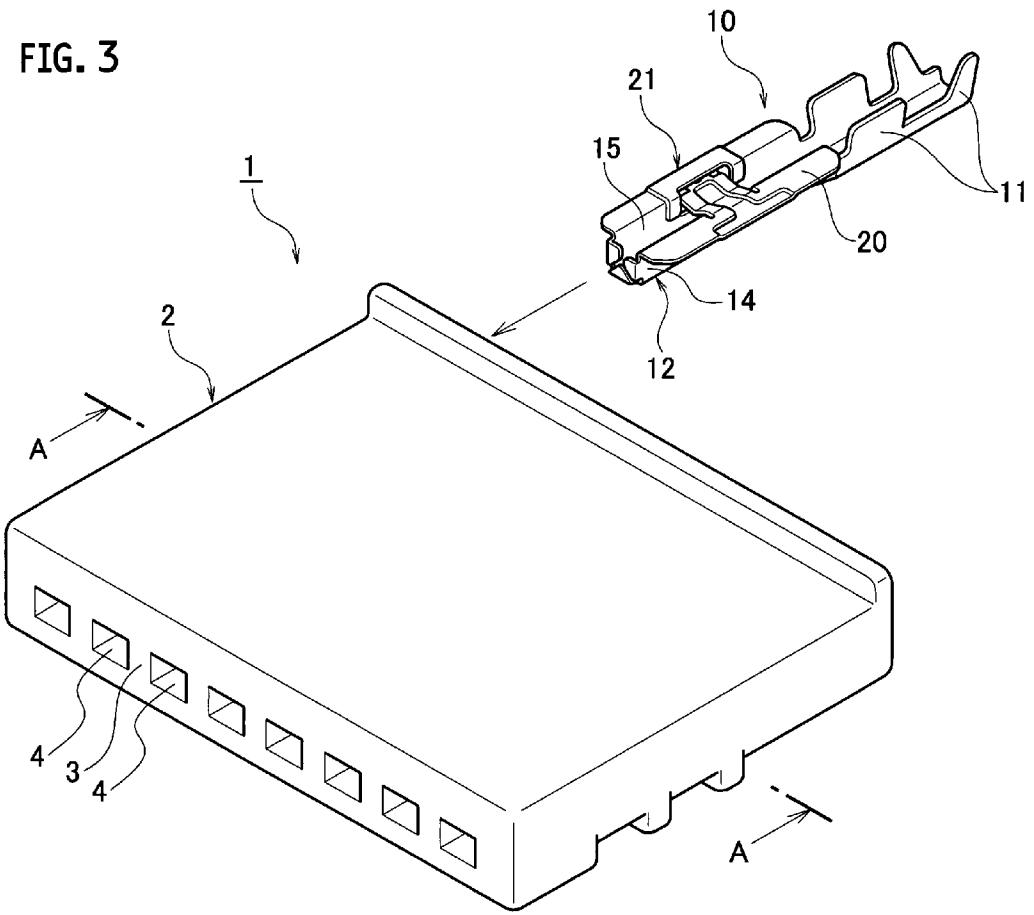
FIG. 3 is an exploded perspective view of a splice box according to an embodiment.
Figure 4A:
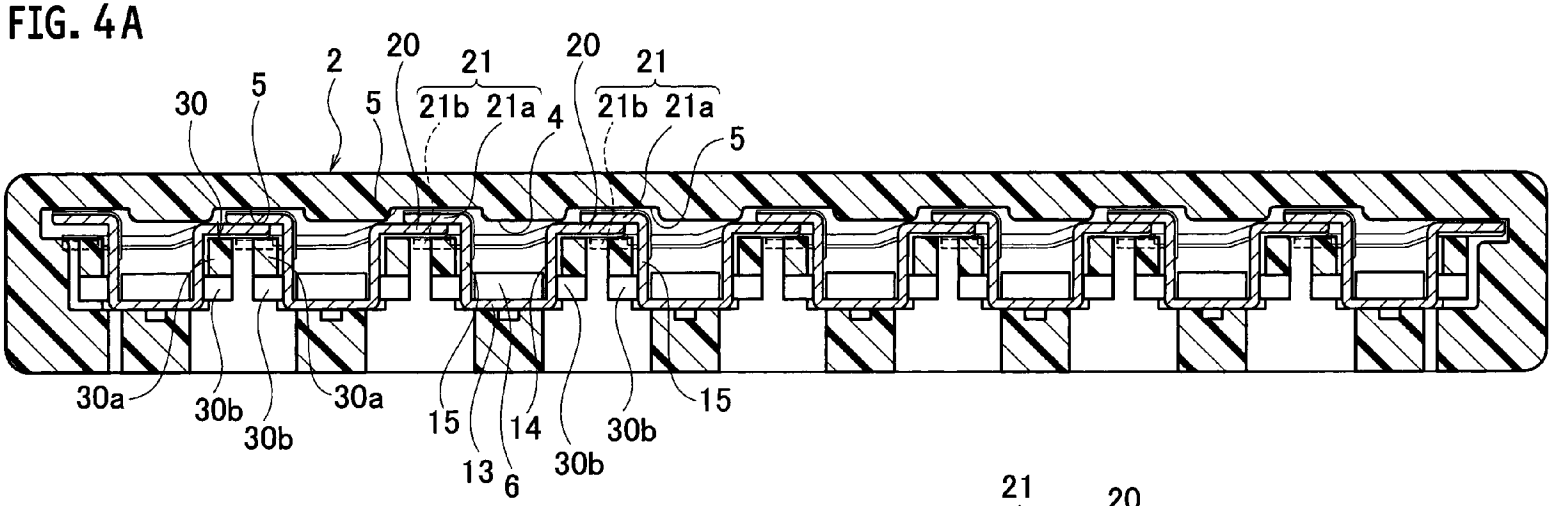
FIG. 4A is a cross sectional view taken along the line A-A in FIG. 3.
Figure 4B:
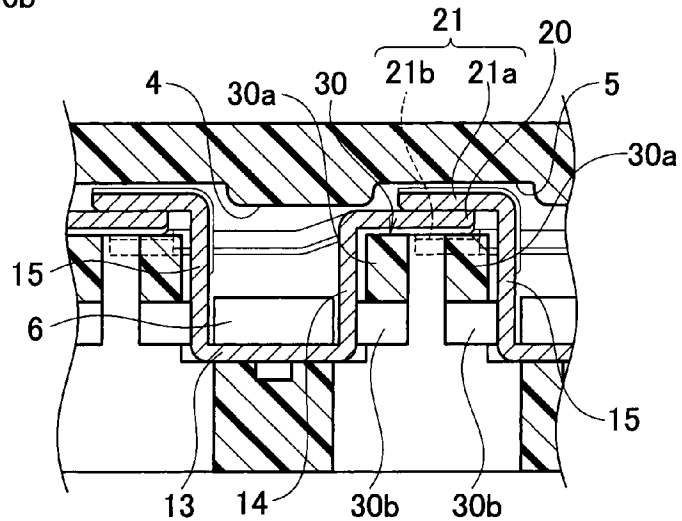
FIG. 4B is an enlarged view of an essential part of FIG. 4A.
Figure 5A:
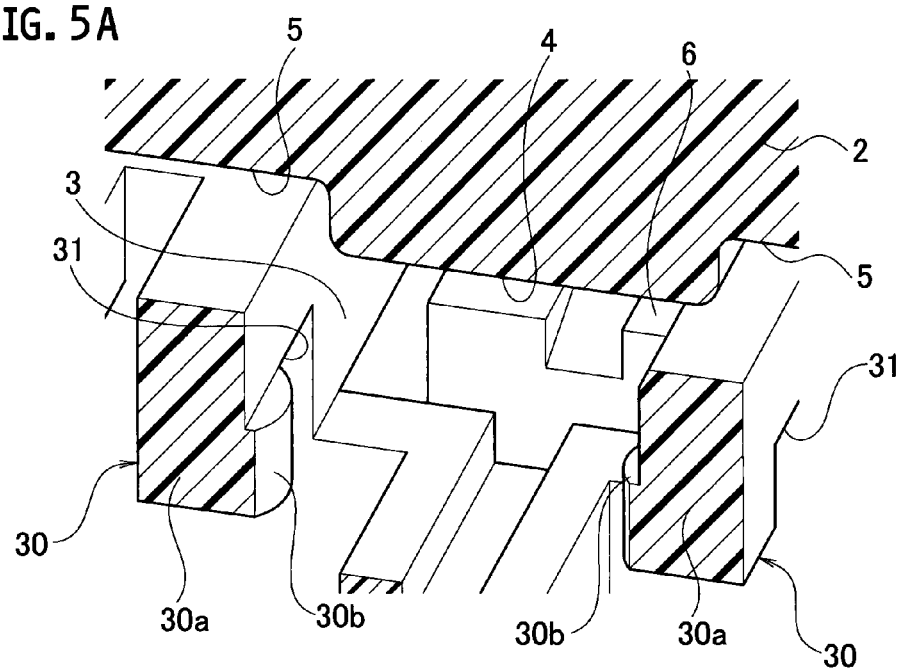
FIG. 5A is a broken perspective view of a housing according to the embodiment.
Figure 5B:
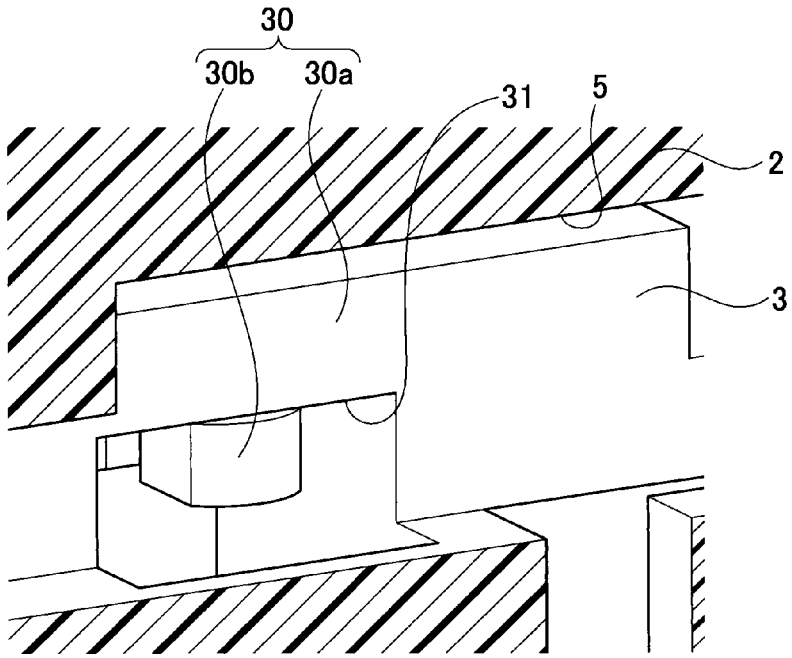
FIG. 5B is a broken perspective view of the housing viewed from a direction different from a direction of FIG. 5A.

Hereinafter, an embodiment will be set forth based on drawings.

FIGS. 3 to 7 illustrate the embodiment. A splice box 1 according to the embodiment includes a housing 2 made of an insulating material and splice terminals 10 to be received in the housing 2. Note that, in FIG. 3, only one splice terminal 10 is described, omitting other splice terminals 10.

The housing 2 includes chambers 4 each partitioned by each of partition walls 3. Each of the partition walls 3 is provided with a slit 5. The slit 5 works to allow the adjacent chambers 4 to be communicated with each other. In the housing 2, each of lances 6 is integrally formed in a position corresponding to each of the chambers 4. Each of the lances 6 is made to protrude to each of the chambers 4 from a bottom face side.

Figure 6:
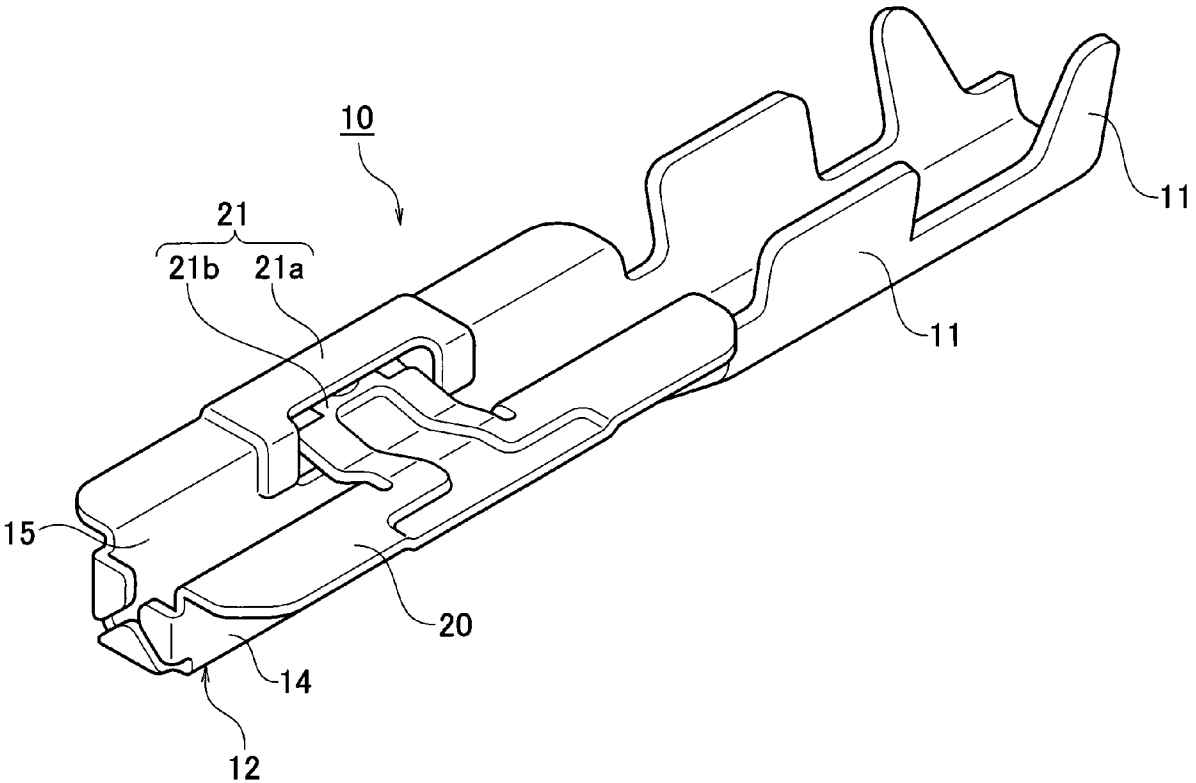
FIG. 6 is a perspective view of a splice terminal according to the embodiment.
Figure 7:
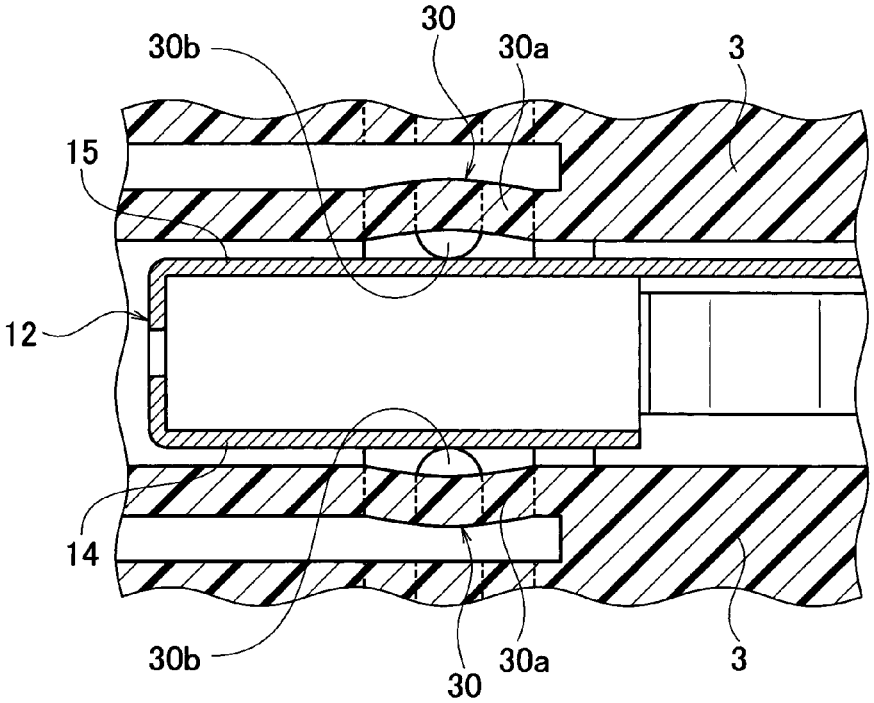
FIG. 7 is a cross sectional view of an essential part of the splice box broken in a transverse direction, according to the embodiment.

Each of the splice terminals 10 is, as illustrated in detail in FIG. 6, formed by bending an electrically conductive plate having a predetermined configuration. Each of the splice terminals 10 includes a wire connecting portion 11 to be connected with a wire, a terminal body portion 12 integrally provided with the wire connecting portion 11, and a first contact portion 20 and a second contact portion 21 which are integrally provided with the terminal body portion 12. The terminal body portion 12 mainly includes a bottom wall portion 13 and a pair of left and right side wall portions 14, 15 bent from respective side edges of the bottom wall portions 13. The terminal body portion 12 is inserted into each of the chambers 4 and thereby received in each of the chambers 4. The bottom wall portion 13 is formed with a lance engaging hole (not illustrated). The lance 6 of the housing 2 is engaged with the lance engaging hole. The above engaging operation so positions each of the splice terminals 10 as not to be removed outwardly from each of the chambers 4.

The first contact portion 20 is formed by being bent horizontally from an upper end of the first side wall portion 14. A height of the first contact portion 20 is set between an upper contact piece portion 21*a* and a lower contact piece portion 21*b*. The second contact portion 21 includes the upper contact piece portion 21*a* bent horizontally outwardly from an upper end of the second side wall portion 15 and the lower contact piece portion 21*b* extending from an inner peripheral edge of the first contact portion 20 and extending horizontally outwardly from the second side wall portion 15. The upper contact piece portion 21*a* and the lower contact piece portion 21*b* are arranged in parallel at an interval. The first contact portion 20 and the second contact portion 21 are inserted into the adjacent slits 5 on left and right. The splice terminals 10 received in the adjacent chambers 4 have such a structure as that the first contact portion 20 of one of the splice terminals 10 is intervened between the upper contact piece portion 21*a* and lower contact piece portion 21*b* of the second contact portion 21 of the other of the splice terminals 10, to be adhered in an overlapped state. The above adhering operation allows the splice terminals 10 to be electrically connected with each other.

Each of the chambers 4 is provided with a pair of elastic portions 30 so contacting the first side wall portion 14 and second side wall portion 15 of each of the terminal body portions 12 as to have an elastic deformation. The elastic portion 30 includes a deformation portion 30*a* provided by a part of the partition wall 3 and a contact protrusion portion 30*b* protruding from the deformation portion 30*a* to the chamber 4 side. With a gap 31 provided in a part of the partition wall 3, the deformation portion 30*a* is formed to be elastically deformable. A distal end face of the contact protrusion portion 30*b*, that is, a contact face to have a contact with the side wall portions 14, 15 is formed into an arc face. Deformation of each of the elastic portions 30 allows the splice terminal 10 to be inserted into the chamber 4.

In the above structure, under a vibrational environment, even when the vibration is transmitted to the splice terminals 10 so as to vibrate the splice terminals 10, since the pair of elastic portions 30 are intervened between the pair of side wall portions 14, 15 of the terminal body portion 12 and the partition walls 3 on both sides, the pair of elastic portions 30 causing the deformation suppress the vibration of the splice terminal 10. Further, even when the clearance between the side wall portions 14, 15 and the partition walls 3 changes due to the temperature change, the pair of elastic portions 30 vary the deformation amount to thereby absorb the clearance change. The absorbing of the clearance change keeps the splice terminal 10's position in the chamber 4 unchanged, thus suppressing the fluctuation of the contact position between the first contact portion 20 and second contact portion 21 of the adjacent splice terminals 10. That is, the pair of elastic portions 30 absorb difference of the thermal expansions between the housing 2 and the splice terminal 10. To summarize the above, the contact resistance increase caused by the vibration or temperature change can be suppressed as much as possible.

Each of the elastic portions 30 includes the deformation portion 30*a* formed by a part of the partition wall 3 and the contact protrusion portion 30*b* protruding from the deformation portion 30*a* to the chamber 4 side. Thus, the elastic portions 30 can be easily formed without another member affixed to the housing 2. Further, compared with a case in which the elastic portion 30 is integrated with the partition wall 3 and formed into a cantilever support structure, the machining dimension to the partition wall 3 can be made in a smaller range, thus enabling to form the elastic portions 30 by a simple machining.

The deformation portion 30*a* is formed to be elastically deformable by providing the gap 31 in a part of the partition wall 3. Thus, the deformation portion 30*a* can be prepared by only forming the gap 31 to the partition wall 3. The distal end face of the contact protrusion portion 30*b*, that is, the contact face to have a contact with the side wall portions 14, 15 is formed into an arc face. Thus, the inserting of the splice terminals 10 into the chambers 4 can be accomplished smoothly.

The second contact portion 21 includes the upper contact piece portion 21*a* and the lower contact piece portion 21*b* arranged at an interval relative to the upper contact piece portion 21*a*. The splice terminals 10 received in the adjacent chambers 4 have such a structure as that the first contact portion 20 of one of the splice terminals 10 is intervened between the upper contact piece portion 21*a* and lower contact piece portion 21*b* of the second contact portion 21 of the other of the splice terminals 10, to be adhered in an overlapped state. Thus, the first contact portion 20 of the one of the first splice terminals 10 and the second contact portion 21 of the other of the splice terminals 10 have a large contact area, thereby electrically connecting the splice terminals 10 with each other assuredly.

What is claimed is:

1. A splice box, comprising:

a housing comprising chambers each partitioned with each of partition walls, and slits each provided at each of the partition walls; and splice terminals each comprising a wire connecting portion to be connected with a wire, a terminal body portion to be inserted into each of the chambers and thereby received in each of the chambers, a first contact portion protruding from a first side wall portion side of the terminal body portion and arranged at one of the slits adjacent to the first side wall portion, and a second contact portion protruding from a second side wall portion side of the terminal body portion and arranged at the other one of the slits adjacent to the second side wall portion, wherein in each pair of adjacent splice terminals received in adjacent chambers, the first contact portion of one of the splice terminals has contact with the second contact portion of the other of the splice terminals to thereby electrically connecting the adjacent splice terminals, the second contact portion comprises an upper contact piece portion and a lower contact piece portion and the first contact portion of the one of the splice terminals is intervened between the first contact piece portion and the second contact piece portion, each of the chambers is provided with a pair of elastic portions so contacting the first side wall portion and second side wall portion of each of the terminal body portions as to have an elastic deformation, and each of the elastic portions includes a deformation portion formed by a part of each of the partition walls and a contact protrusion portion protruding from the deformation portion to the chamber side.

2. The splice box according to claim 1, wherein the deformation portion is formed to be elastically deformable by providing a gap in a part of each of the partition walls, and the contact protrusion portion has a contact face to have a contact with the side wall portions and formed into an arc face.

3. The splice box according to claim 1, wherein the pair of elastic portions so contacts the first side wall portion and second side wall portion of each of the terminal body portions to suppress the vibration of the splice terminals.

4. The splice box according to claim 1, wherein a deformation amount of the pair of elastic portions varies to absorb a clearance change between the first side wall portion, the second side wall portion and the partition walls due to a temperature change.

5. The splice box according to claim 4, wherein the deformation amount of the pair of elastic portions varies to absorb the clearance change such that a position of each of the splice terminal with each of the chambers is unchanged and a fluctuation of a contact position between the first contact portion and the second contact portion of the adjacent splice terminals is suppressed.

6. The splice box according to claim 4, wherein the deformation amount of the pair of elastic portions absorbs a difference of thermal expansions between the housing and the splice terminal.

7. The splice box according to claim 1, wherein the deformation portion is formed to be elastically deformable by providing a gap in a part of the partition wall.

8. The splice box according to claim 1, wherein the first contact portion of the one of the splice terminals is intervened between the first contact piece portion and the second contact piece portion to be adhered in an overlapped state.

9. The splice box according to claim 1, wherein the first contact portion of the one of the splice terminals is intervened between the first contact piece portion and the second contact piece portion to provide a large contact area between the first contact portion and the second contact portion.

* * * * *